United States Patent [19]

Kolb et al.

[11] Patent Number: 4,955,307

[45] Date of Patent: Sep. 11, 1990

[54] DEVICE ON SEWING MACHINES FOR THE TRANSPORT OF WORK PIECES

[75] Inventors: Wolfgang Kolb, Sippersfeld; Ernst Albrecht, Hochspeyer, both of Fed. Rep. of Germany

[73] Assignee: Pfaff Industriemaschinen GmbH, Kaiserslautern, Fed. Rep. of Germany

[21] Appl. No.: 360,260

[22] Filed: Jun. 2, 1989

[30] Foreign Application Priority Data

Jun. 6, 1988 [DE] Fed. Rep. of Germany ..... 3819262

[51] Int. Cl.[5] ..... D05B 33/00

[52] U.S. Cl. ..... 112/304; 112/121.29

[58] Field of Search ..... 112/121.12, 121.15, 112/121.29, 2, 10, 304

[56] References Cited

U.S. PATENT DOCUMENTS

| | | | |
|---|---|---|---|
| 3,204,590 | 9/1965 | Rockerath et al. | 112/304 X |
| 3,482,540 | 12/1969 | Reid et al. | 112/2 X |
| 3,534,954 | 10/1970 | Lynch | 112/121.15 |
| 4,813,364 | 3/1989 | Boser | 112/304 |
| 4,841,889 | 6/1989 | Schips | 112/121.12 X |

FOREIGN PATENT DOCUMENTS

| | | | |
|---|---|---|---|
| 3817544 | 12/1988 | Fed. Rep. of Germany | 112/304 |

*Primary Examiner*—Werner H. Schroeder
*Assistant Examiner*—David K. Suto
*Attorney, Agent, or Firm*—McGlew & Tuttle

[57] ABSTRACT

A device for use with sewing machines for transport of work pieces. The transport device removes finished workpieces from a sewing area and feeds the workpieces to a transfer point at which the end section of the work piece is held with little force to allow the workpiece to be gripped by a stacking element. The arrangement allows for the next workpiece to be inserted into the sewing area simultaneous with the removal of the finished workpiece. The transport device includes a swivelable arm carrying a driven conveyor belt. The arm may be swivelled upward once the front section of the work piece has been moved underneath the swivelling axis of the arm, so that a new workpiece can be inserted. The conveyor belt can be arrested before the end section of the workpiece passes through. The conveyor belt contact pressure can be reduced such that the work piece can be pulled out easily by a stacker.

11 Claims, 3 Drawing Sheets

1
2
3
4
5
6
7
8
9
10
13
29
51
52
27
36
46
30
50
45
44
43
42
41
48
47
40
38
39

DEVICE ON SEWING MACHINES FOR THE TRANSPORT OF WORK PIECES

FIELD OF THE INVENTION

The invention relates to a work piece transport device for a sewing machine for transporting a workpiece lying on a table top from a sewing area to a transfer area using a conveyor belt looping around a drive disc and a deflection disc carried by a pivotal arm connected to a compressed-air cylinder actuator.

BACKGROUND OF THE INVENTION

In order to achieve short processing times of work pieces to be processed on a sewing machine, e.g. for the sewing of button holes on the front of the shirt it is advantageous to remove a finished work piece quickly from the sewing area and to feed it in a defined, precise manner into a stacker and to feed the next work piece into the sewing machine in a time overlap.

German publication 22 13 576 in International Class D05 B, group 23/00, describes a sewing automat having two continuously driven conveyor belts which are arranged parallel and at a distance with regard to one another, and which are arranged above a table top carrying the work pieces and which transport the work pieces in a continuous motion along the stitch formation area and away from the sewing machine. The conveyor belts also extend above a feeding table which can be moved from a low loading position to a high transfer position in which the conveyor belts can take over a placed and aligned work piece and feed it to the sewing machine.

The liftable and lowerable feeding table allows for overlapping operation, however, there is a danger that with thin and flexible work pieces the front edge of the work piece is caught in the joint between the table top and the feeding table and that it rolls up. Also, due to the continuous operation of the conveyor belts it is difficult to pass the work piece on to or take it from a stacker in a defined manner.

U.S. Pat. No. 43 80 205 in International Class D05 B, group 1/12 describes a work piece transport device for an overhand sewing machine arranged on a table top. The transport device has either one or two conveyor belts arranged parallel and at a distance with regard to one another, which are led over a drive disc arranged mounted fixedly in a bearing mounted fixedly and a deflection disc, which is arranged on an arm pivoting around a vertical and a horizontal axis and whose swivelled position can be fixed by means of two clamping screws. When no longer needed, the arm with the deflection disc is manually swivelled laterally from below the horizontally arranged presser foot carrying lever of the sewing machine and then it is swivelled upward into a resting position in which it is arrested. For the execution of a thread cutting process the holder for the bearings of the arm can be swivelled around the axis of the drive disc by means of a compressed-air pneumatic cylinder which results in a minor upward movement of the deflection disc.

The known workpiece transport device is adjusted to the design and the elevated position of the overhand sewing machine mounted to the table top and is unsuited for the removal of work pieces lying on a table top which is aligned with the work piece contact surface of the sewing machine. Furthermore, no measures were taken that allow an overlapping operation for the sewing and feeding of the next work piece and that guarantee a defined, precise transfer of a finished work piece to a stacker.

SUMMARY AND OBJECTS OF THE INVENTION

It is an object of the invention to create a workpiece transport device for sewing machines which removes the finished work piece from the sewing area and which transports it in a defined manner to a deposit area (transfer area) which is situated in the reach of a stacker, and which at the same time allows for the placement of the next work piece in the sewing area.

According to the invention, a workpiece transport device is provided for a sewing machine. A table top is provided extending from a sewing area to a transfer area. The pivotal arm is provided carrying a deflection disc at a first end and a drive disc at a second end. The conveyor belt loops around the deflection disc and around the drive disc. Swivel carrier means is provided connected to a swivel carrier actuator and connected to the pivotal arm for pressing the pivotal arm into a workpiece on the table top with a predetermined force and pressing the pivotal arm into the workpiece with a force less than the predetermined force depending upon the position of the workpiece relative to the conveyor belt and the pivotal arm is in a swivelled-up position.

By means of arranging the swivelable arm carrying the conveyor belt on a swivel carrier and admitting the swivel carrier with contact pressure depending on the swivelling position of the arm, the arm can be pushed down relatively strongly for the removal of the processed work piece from the sewing area. By this means the conveyor belt is pressed down by the drive disc as well as by the deflection disc with sufficient strength for an exact and frictiontight gripping of the work piece.

Once the conveyor belt has removed the processed work piece from the sewing area and has moved it over an edge of the table top and downward into the reach of a stacker, its drive is deactivated before the trailing edge of the work piece reaches the drive disc of the conveyor belt and the contact pressure is reduced so far that the work piece hanging down partly is still held securely but can be pulled from beneath the conveyor belt by the stacker without any significant exertion of force.

In the further course of the transport of the work piece by means of the conveyor belt, once the front edge of the work piece has moved under the drive disc of the conveyor belt, the arm with the conveyor belt is swivelled upward so far that during the further transport movement executed only by the drive disc and the conveyor belt looping around it, the next work piece can already be positioned in the sewing area and under the conveyor belt.

In the case that work pieces have overlength and extend to a location under the drive disc of the conveyor belt even in the sewing position, the arm with the conveyor belt can be lifted off the table top completely by means of a respective swivelling of the swivel carrier, so that the work piece is hindered by the conveyor belt neither during the aligning nor the sewing. This is accomplished by the provision of the swivel carrier actuator or swivel driving device which acts to pull the pivotal arm off the table top.

The swivel driving device is preferably a double-acting compressed-air cylinder having cylinder chambers which may be admitted with air under pressure separately and also simultaneously for the generation of the differential pressure This arrangement provides particularly simple embodiment of the swivel drive device for the swivel carrier.

By means of the provision of a coupling element mounted on the swivel carrier, the coupling element may act as a bearing for a transmission shaft or cardan shaft which connects the drive disc with a driving device such that the driving device, the swivel carrier, the coupling element and the transmission shaft form essentially a parallel crank mechanism. It is guaranteed that the plane of rotation of the conveyor belt in any position of the swivel carrier is essentially vertical with regard to the table top, so that the contact surface of the conveyor belt in a transverse direction with regard to the transport direction is always parallel to the table top even with varying thickness of the work pieces and therefore work pieces or varying thickness are always gripped and transported evenly.

By means of the provision of a spring mechanism connected to the swivel carrier, to balance the weight of the pivotal arm and the elements carried by the pivotal arm, the effective contact pressure of the arm and the conveyor belt on the work piece can be varied as the contact pressure generated by the swivel drive device is increased by the more or less compensated for weight of the arm and the elements carried by it.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENT

Figures 1, 2:
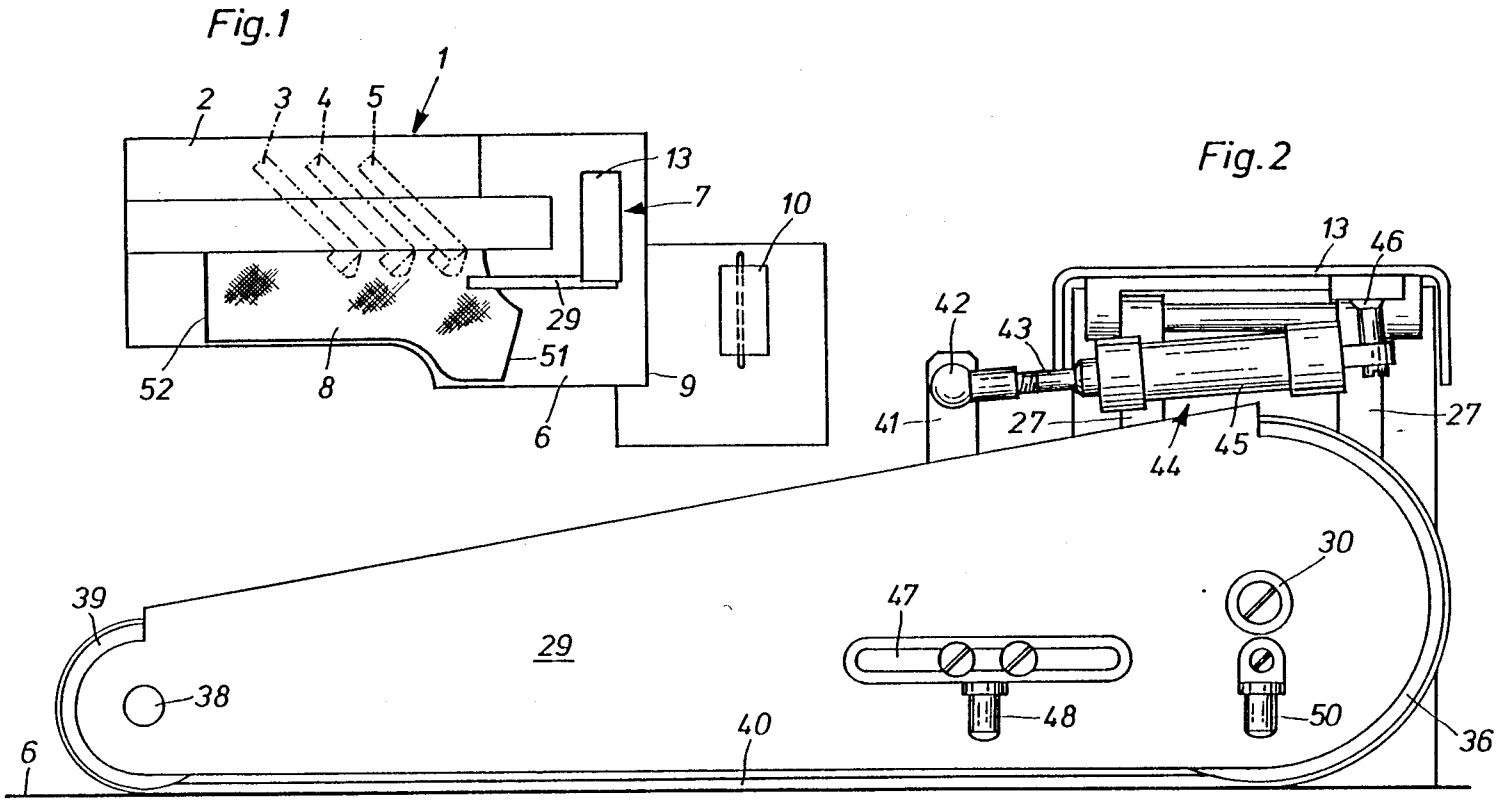
FIG. 1 is a top schematic representation of a sewing device with a work piece transport device and a stacker.
FIG. 2 is a view of the transport device.

The sewing device 1 has a frame 2 on which three sewing machines 3, 4, 5 are arranged next to one another and spaced apart. A L-shaped table top 6 is fastened to the frame 2 and is aligned with the work piece contact surfaces of the sewing machines 3, 4, 5 (not shown in detail). A transport device 7 for the work piece 8 on the table top 6 is arranged on the table top 6. On the side of the table top 6 a stacker 10 of a known kind is partly overlapped by the table top 6.

Figure 3:
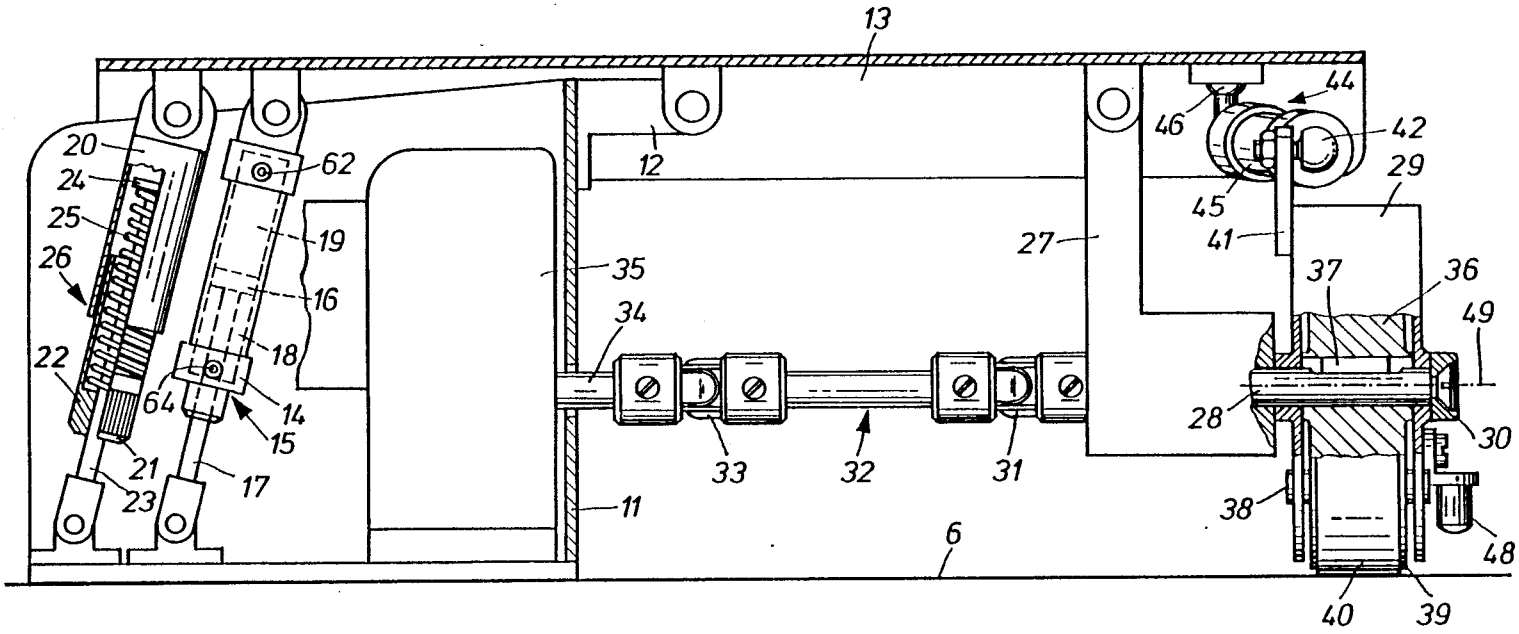
FIG. 3 is a sectional lateral view of the transport device.

The transport device 7 has a partially open housing 11 which is fixedly mounted to the table top 6, and to which a bracket 12 is fastened (see FIG. 3). A longitudinal swivel carrier 13 having a flat U-shaped cross-section is mounted swivelably on the bracket 12. The housing 14 of a compressed-air cylinder or swivel carrier actuator 15 is coupled with the swivel carrier 13. The piston rod 17 carrying the piston 16 is coupled to the bottom of the housing 11. The cylinder chamber of the housing 14 is separated into two cylinder chambers 18, 19 by the piston 16. A first compressed air connection 62 and a second compressed air connection 64 provide compressed air to and remove compressed air from the two cylinder chamber 18, 19 respectively.

Furthermore, a sleeve 20 having inner threading is mounted swivelably on the swivel carrier 13. An adjustable sleeve 21 having outer threading is screwed into the sleeve 20. A rod 23 which is coupled to the bottom of the housing 11 is led through the bottom 22 of the adjustable sleeve 21, said rod 23 having a stop disc 24 at its end. A pressure spring 25 is arranged on the rod 23, which is supported with one end on the bottom 22 and with the other end on the stop disc 24. The elements 20 to 25 form an adjustable spring mechanism 26.

A fork-shaped coupling element 27 is swivelably mounted to the swivel carrier 13 and a shaft 28 is received in it. The shaft 28 protrudes from the coupling element 27 on both sides. A longitudinal arm 29 having a U-shaped cross section is mounted swivelably on one of the protruding sections of the shaft 28, said arm lying close to the coupling element 27 on one side and being axially secured by means of a stop disc 30. A universal joint 31 of a transmission or cardan shaft 32 is mounted to the other end of the shaft 28 protruding from the coupling element 27. The transmission shaft is rotationally rigidly connected to the driving shaft 34 of a gear motor 35 by means of a second universal joint 33.

Furthermore a drive disk 36 positioned within the arm 29 is arranged on the shaft 28 and is connected rotationally rigidly to the shaft 28 by means of a feather key 37. A deflection disc 39 is mounted freely rotatable on a pin 38 arranged on the free end of the arm 29. A conveyor belt loops around the drive disc 36 and the deflection disc 39.

The piston rod 43 of a compressed-air cylinder 44 is coupled with a dog 41 connected to the arm 29 by means of a ball-and-socket joint 42 The housing 45 of the compressed-air cylinder 44 is coupled to the swivel carrier 13 by means of a ball-and socket joint 46.

A first optical sensor 48 is arranged in a longitudinal hole 47 of the arm 29. Its distance relative to the drive disc 36 is adjustable. A second optical sensor 50 is fixedly mounted below the axis of the drive disc 36.

Operation

Figure 4:
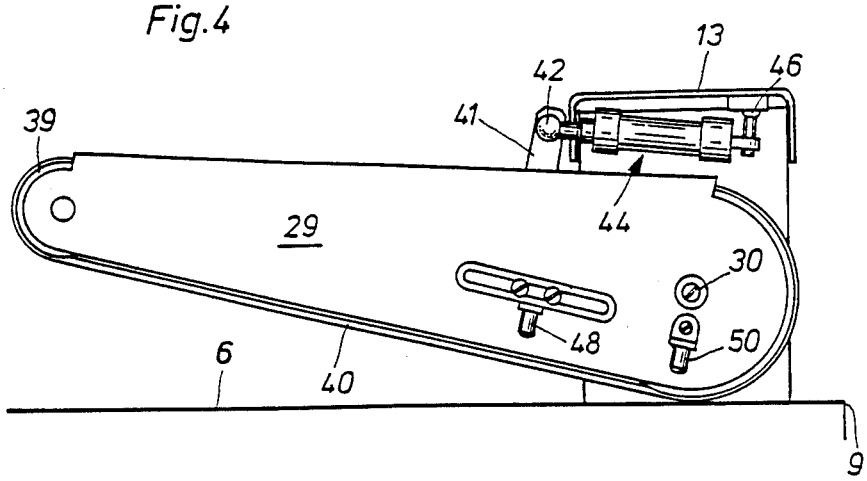
FIG. 4 is a view of the transport device with the arm lowered.

During the sewing process in which three sewing operations, e.g. button holes, are executed on the work piece 8 at the same time by the sewing machines 3, 4, 5 the arm 29 is swivelled upward and around the axis 49 of the drive disc 36 into the position shown in FIG. 4 by means of the compressed-air cylinder 44. In this position the work piece 8, whose front edge lies underneath the deflection disc 39 is not influenced by the transport device and can be moved freely. At this point the gear motor 35 is switched off and both cylinder chambers 18, 19 of the compressed-air cylinder 15 are admitted with compressed air. As the face of the lower cylinder chamber 18 is smaller than the upper cylinder chamber 19 by the cross-sectional surface of the piston rod 17 a higher force of pressure is generated in the upper cylinder chamber 19 than in the lower cylinder chamber 18. For this reason the housing 14 of the compressed-air cylinder 15 is pushed upward and the swivel carrier 13 receives a clockwise torque according to FIG. 3, by means of which the drive disc 36 is pushed against the table top 6 by approx. 2 N.

Figure 5:
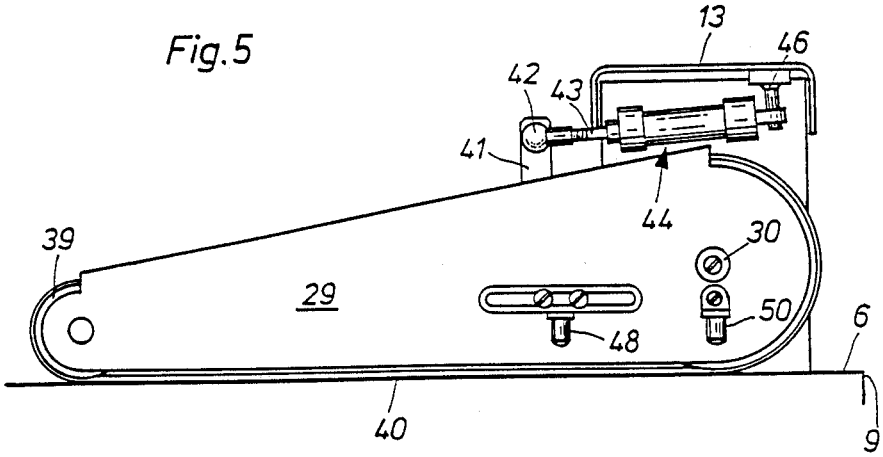
FIG. 5 is a view of the transport device with the arm swivelled upward.

Once the sewing process has ended and the work piece is processed completely, the gear motor 35 is switched on and the arm 29 is swivelled downward into the position according to FIG. 5 by the compressed-air cylinder. Simultaneously the lower cylinder chamber 18 of the compressed-air cylinder 15 is evacuated, thus giving the swivel carrier 13 a strong torque and the drive disc 36 as well as the now lowered deflection disc 39 are pushed downward with approx. 20 N. As soon as the part of the conveyor belt 40 positioned below the pin 38 grips the work piece 8, it pulls it on the table top 6 toward the lateral edge 9 and the stacker 10.

As soon as the optical sensor 50 senses the front edge 51 of the work piece 8 the arm 29 is swivelled upward around the axis 49 into the position shown in FIG. 4 by means of the compressed-air cylinder. The drive disc 36 still pushing down at 20 N has the effect that the conveyor belt 40 moves the work piece 8 further in the direction of the lateral edge 9, the part of the work piece 8 transported over the lateral edge 9 hanging down being within the reach of the stacker 10.

As soon a the trailing edge 52 of the work piece 8 is moved beyond the point where the front edge 51 of the work piece is situated during the sewing, the next work piece 8 can be delivered to the table top 6 and aligned.

Once the sensor 48 has detected the trailing edge 52 of the work piece 8, the gear motor 35 is deactivated [switched off] and the bottom cylinder chamber 18 is admitted with pressure again. Due to the differential pressure in the compressed-air cylinder 15 the end of the work piece 8 is held at a low pressure of 2 N while the conveyor belt 40 is standing. This contact pressure is calculated so that the conveyor belt 40 can hold the work piece 8 whose major part hangs down over the lateral edge 9 but that the stacker 10 can still pull the work piece 8 from beneath the conveyor belt 40.

The contact pressure prevailing at the drive disc 36 during the simultaneous admission with pressure of the two cylinder chambers 18 19 can be adjusted by means of the adjusting sleeve 21 by compensating more or less for the weight of the arm 29 and the elements carried by it by tensing the pressure spring 25 more or less.

Figure 6:
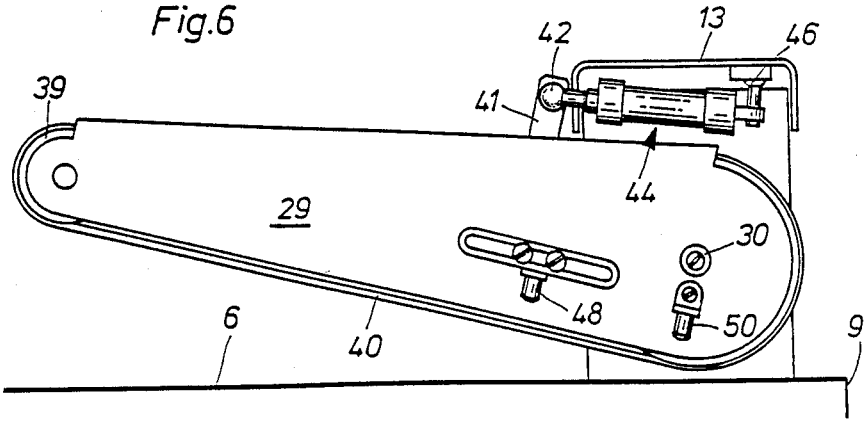
FIG. 6 is a view of the transport device with the arm lifted completely.

If necessary, the arm 29 can be lifted off the table top 6 completely with the conveyor belt 40 (see FIG. 6). For this purpose the upper cylinder chamber 19 of the compressed-air cylinder 15 is evacuated, therefore the lower cylinder chamber 18, which is still under pressure, pulls the housing 14 down and therefore moves the swivel carrier 13 counter-clockwise according to FIG. 3.

While specific embodiments of the invention have been shown and described in detail to illustrate the application of the principles of the invention, it will be understood that the invention may be embodied otherwise without departing from such principles.

What is claimed is:

1. A workpiece transport device for sewing machines, comprising:

a table top extending from a sewing area to a transfer area;

a pivotal arm;

a deflection disc connected to a first end of said pivotal arm;

a drive disc connected to a second end of said pivotal arm;

a conveyor belt looping around said deflection disc and said drive disc; and swivel carrier means connected to a swivel carrier actuator and connected to said pivotal arm, said swivel carrier means for pressing said pivotal arm onto a workpiece on said table top with a predetermined force and pressing said pivotal arm onto the workpiece with a force less than said predetermined force, depending upon the position of the workpiece relative to the conveyor belt when the arm is in a swivelled-up position.

2. A workpiece transport device according to claim 1, wherein said swivel carrier actuator acts on said swivel carrier means to lift said pivotal arm out of contact with the workpiece on said table top.

3. A workpiece transport device according to claim 1, wherein said swivel carrier actuator includes a double action-compressedair cylinder cooperating with a piston to define a first cylinder chamber and a second cylinder chamber, a first compressed air connection connected to said first cylinder chamber for supplying compressed air to and exhausting compressed air from said first cylinder chamber and a second compressed air connection, connected to said second cylinder chamber for supplying compressed air to and exhausting compressed air from said second cylinder chamber, said first and second compressed air connections being separately actuatable for the generation of a differential pressure between said first and second cylinder chambers.

4. A workpiece transport device according to claim 1, wherein said pivot arm is mounted on a coupling element connected to the swivel carrier, said coupling element including a bearing portion, said driving disc being keyed to a shaft positioned within said bearing portion of said coupling element, said shaft being connected to a transmission shaft connecting said driving disc with a driving device.

5. A workpiece transport device according to claim 1, wherein said swivel carrier is connected to an adjustable spring mechanism, said adjustable spring mechanism to balance the force of said pivotal arm acting on said swivel carrier.

6. A workpiece transport device for sewing machines, comprising: a table top extending from a sewing area to a transfer area; a pivotal arm; a deflection disc connected to a first end of said pivotal arm; a drive disc connected to a second end of said pivotal arm; a conveyor belt looping around said deflection disc and looping around said drive disc; a swivel carrier mounted on a pivot connected to said table top, said carrier pivotal about said pivot; swivel carrier actuator means connected to a first end of said swivel carrier for pivoting said swivel carrier about said pivot for fixing the position of said swivel carrier relative to said table top, said pivotal arm first end being connected to a second end of said swivel carrier, said pivotal arm being forced onto a workpiece as said swivel carrier is urged in a first pivotal direction and said pivotal arm being lifted free of said table top upon movement of said swivel carrier in a second pivotal direction.

7. A workpiece transport device according to claim 6, wherein said pivotal arm is connected to said swivel carrier by a compressed air cylinder, said swivel carrier being connected to a coupling element defining a bearing portion, a shaft extending through said bearing portion being fixed to said driving disc for rotation therewith, said pivotal arm being mounted on said shaft for rotation about said shaft, said compressed air cylinder including a compressed air cylinder rod connected to said pivotal arm for pivoting said pivotal arm about said shaft.

8. A workpiece transport device according to claim 6, wherein said shaft is connected to a motor drive by a universal joint, said coupling element being pivotally connected to said swivel carrier.

9. A workpiece transport device according to claim 6, wherein said carrier actuator means includes a double action compressed-air cylinder cooperating with a piston rod to define a first cylinder chamber and a second cylinder chamber, one of said piston rod and said cylinder being connected to said table top and said swivel carrier respectively, a first fluid pressure connection connected to said first cylinder chamber and a second fluid pressure connection connected to said second cylinder chamber for generation of a differential pressure between said first cylinder chamber and said second cylinder chamber.

10. A workpiece transport device according to claim 6, further comprising counter-balance means connected to said first end of said swivel carrier to balance the force of of said pivotal arm acting on said swivel carrier.

11. A workpiece transport device according to claim 10, wherein said counter-balance means includes an adjustable spring mechanism including a first element having exterior threads defining a central cavity and a second element having interior threads defining a central cavity, said second element interior threads mating with said first element exterior threads, said second element being connected to said swivel carrier, said first element having a bore, a rod connected to said table top extending through said bore into said central chamber, said rod being connected to a stop disc, a compression spring being positioned about said rod between said stop disc and an interior end of said first member.

* * * * *